US005161332A

United States Patent [19]

Koch

[11] Patent Number: 5,161,332

[45] Date of Patent: Nov. 10, 1992

[54] CHUCKING APPARATUS FOR THE COMBINED WORKING OF ROLLING BEARING RINGS

[75] Inventor: Peter Koch, Nuremberg, Fed. Rep. of Germany

[73] Assignee: GMN Georg Muller Nurnberg AG, Fed. Rep. of Germany

[21] Appl. No.: 652,539

[22] Filed: Feb. 8, 1991

[30] Foreign Application Priority Data

Feb. 24, 1990 [DE] Fed. Rep. of Germany ..... 4005911

[51] Int. Cl.[5] ..... B24B 5/18

[52] U.S. Cl. ..... 51/108 R; 51/236; 51/237 T

[58] Field of Search ..... 51/108 R, 105 R, 103 R, 51/103 WH, 236, 237 R, 237 M, 237 T, 326, 281 P, 327, 291

[56] References Cited

U.S. PATENT DOCUMENTS 2,527,791 10/1950 Brink ..... 51/108 R 4,656,789 4/1987 Schwar ..... 51/105 R

*Primary Examiner*—Bruce M. Kisliuk

*Assistant Examiner*—Eileen P. Morgan

*Attorney, Agent, or Firm*—Steinberg & Raskin

[57] ABSTRACT

In a chucking apparatus for the combined grinding and honing working of a racetrack surface of a roller bearing external ring, a first chucking device comprising a pair of glide shoes and a second chucking device comprising a hydrostatic glide bearings wherein the first chucking device the grinding is integrated as a multiple arrangement into an indexable round table while the second chucking device is capable of being moved by simple axial shifting into the honing chucking device integrated into the round table.

6 Claims, 2 Drawing Sheets

CHUCKING APPARATUS FOR THE COMBINED WORKING OF ROLLING BEARING RINGS

BACKGROUND OF THE INVENTION

As essential individual components of a rolling bearing, rolling bearing rings are exposed to considerable mechanical loads. Since the force transmission on the racetrack takes place due to frequency related stress the bearings must in each case be hardened. The last two steps in working these racetracks are the grinding and the honing.

The profile of the racetrack is put into final form by the grinding process. Generally, a circumferential grinding disk mounted on a tool spindle is disposed with its longitudinal axis parallel to the axis of symmetry of the rolling bearing ring to be worked. The circumference of this grinding disk has in its radial section a profile which corresponds to the negative of the profile to be worked into the track. If a grinding disk is positioned axially to the rolling bearing ring to be ground and then advanced radially while being rotated toward the rotating workpiece the desired racetrack profile is produced on the racetrack of the rolling bearing ring. The radial advance motion is stopped when the desired radial dimension of the racetrack profile is reached. Subsequently, the length of advance is traversed back in rapid motion, the worked workpiece is exchanged against an unworked workpiece, and a new working cycle can begin. From time to time the grinding disk which is subjected to continuous abrasion must be newly profiled between two working cycles. The most modern machines of this type today have tool spindles operating with a rotational speed of up to 180,000 revolutions per minute, the bearing ring to be worked rotating at approximately 1500 revolutions per minute, and the clock timer per working cycle is only a few seconds. The goal of their grinding process is providing the rolling bearing racetrack with its final form. Since their measuring accuracy is of utmost importance for the function and the operation of the rolling bearing, the advance motion must follow very precisely a given path function and must especially at its extreme point assume a geometrically exact position. Since all relative motions between tool and workpiece are path-bound the machine construction must be implemented to very small tolerance. For this reason so-called glide shoes have inter alia proven to be reliable for the support of the rotating workpiece. They represent a very rigid member in the force flow of the machine and therewith contribute significantly to the retention of the dimensional accuracy of the finished workpiece.

The surface generated by the grinding process is generally not sufficient for the running surface of the rolling bearing so that normally a honing process follows. In this fabrication step the basic working speed is achieved through the rotation of the workpiece about its axis of symmetry. A honing stone whose contact zone is adapted to the racetrack profile of the rolling bearing is pressed under a predetermined force onto the racetrack profile. In this manner through the contact points between workpiece and tool which shift continuously, the surface character assumes a uniform shape. Simultaneously, the abrasion generated on the honing stone is thereby made uniform such that its contour is retained to the largest possible extent. At the conclusion of the honing process, however, care must be taken because the honing traces in the final analysis are unavoidably extended in the direction of motion of the rolling elements and do not show any component perpendicular to it. For that reason the honing frequency is markedly reduced toward the end of the working process. The rotational speed of the workpiece can be varied and can reach up to 15,000 revolutions per minute. In contrast to the previously described grinding process the honing stone is guided in a manner which is not path-bound but rather force-bound. The requirement for a particularly rigid machine construction here becomes irrelevant. Instead a defined flexibility is required so that through the amount of the advance the working force can specifically be given. For this reason for the bearing of the rotating workpiece a defined flexible type of bearing is used wherein a hydrostatic glide bearing has proven useful. The feed introduced into this force flow has therein no decisive influence on the capacity to retain dimensional accuracy of the worked workpiece. However, it determines decisively the force effective in the working. Moreover, the hydrostatic glide bearing has the advantage that the residual waves unavoidably present in the external surface of the rolling bearing rings are averaged out in the best possible manner and the radial deviations of the workpiece resulting therefrom are largely reduced. This has especially advantageous effects on the noise behavior of the rolling bearing completed later. In the general case a single honing process is not sufficient for achieving the required surface quality so that normally the honing is divided into preliminary final honings wherein both individual steps are carried out according to the identical scheme, albeit with different tools.

The final working of the rolling bearing rings according to the current state of the art requires for each of the two fabrication steps "racetrack grinding" and "racetrack honing" one separate machine tool each. In this method serious disadvantages are encountered. Considerable investments with high costs are required. Furthermore, the racetrack-ground ring must be transported to the honing machine which requires additional expenditures. Especially in the case of material flow technology with linkage of the machines with each other considerable means of handling, transporting, and storage arrangements are involved. A further disadvantage of this known fabrication technology consists in that the rolling bearing rings, unsymmetrical with respect to their axial extension, are normally supported in any given orientation position between grinding and honing and on being placed into the honing machine must again be oriented into the correct position with respect to their axial orientation. While, with bearing rings which with respect to their central position are unsymmetrical this requirement is unavoidable, it is also to an increasing extent made with symmetrical rings since the rolling bearing ring even with highly precise working is never completely symemtrical. Since the grinding as well as the honing process refer to the same racetrack profile, for high precision fabrication it is advantageous if the ring leaving the grinding machine is honed in precisely the same axial orientation. If, in contrast, the ring is inserted arbitrarily with respect to its axial orientation, then the honing stone will not be able to follow the contour given by the grinding because of the symmetry of the rings, which is never complete. For this reason, even with rolling bearing rings with symmetrical nominal profile, placing these rings into the correct position into the honing machine is advantageous. However, this can only be realized with considerable expenditures and requires for example, especially in the case of small ring dimensions, a very expensive linkage of the successive grinding and honing machines.

Under these circumstances it is desirable to combine the process steps for the grinding and honing process in such a way that a workpiece is first ground and then honed in the same chucking. For the above-mentioned reasons this is not possible since the requirements made of the bearing of the workpiece are oppositely directed.

SUMMARY OF THE INVENTION

The present invention is based on creating an apparatus which permits the grinding process and the immediately succeeding honing process upon the same workpiece in the axially identical orientation.

It is the subject matter of the present invention to implement the workpiece chucking and bearing for both working steps so that a grinding and honing is possible in a single machine.

The two receiving arrangements are disposed according to the invention axially one behind the other so that the rolling bearing ring to be worked is first received by a pair of glide shoes for grinding and subsequently is pushed for the subsequent honing axially into an immediately adjacent hydrostatic glide bearing where the honing is carried out.

BRIEF DESCRIPTION OF THE DRAWINGS

The following Figures explain an advantageous embodiment of a workpiece chucking according to the invention. These Figures are shown as follows.

DESCRIPTION OF THE PREFERRED EMBODIMENTS

Figure 1:
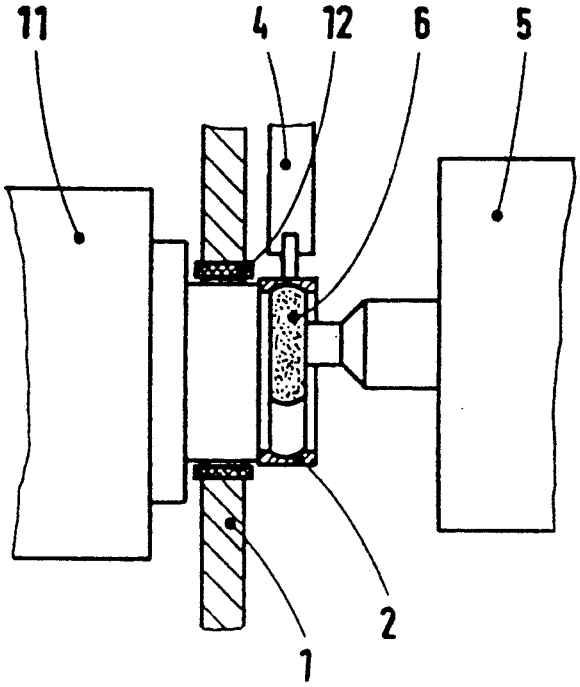
FIG. 1 illustrates the workpiece chucking during the grinding.
Figure 2:
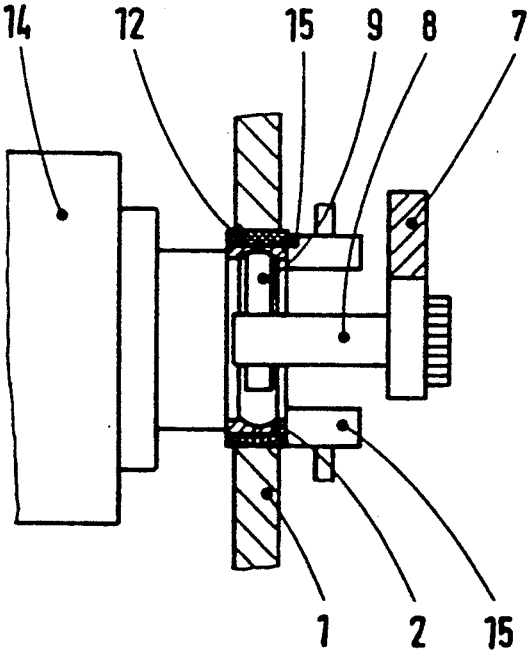
FIG. 2 illustrates the workpiece chucking during the honing, process.

For the grinding process, the workpiece (2) is introduced via a (not shown) feed conduit into the working area in such a way that the external surface area of the rolling bearing ring rests on the glide shoes (3) and (4) whereby its radial position is precisely determined. During grinding, the support of the workpiece by glide shoes proves advantageous since through this support the greatest possible rigidity and therefore the best possible dimensional accuracy during the working is ensured. For the axial fixing and for the initiation of the rotational motion the bearing ring is tightened with its axial annular-form front face against a workpiece spindle (11), for example electromagnetically. Via the frictional closure of this surface pairing the rotational motion is introduced into the workpiece. For the grinding process the grinding spindle (5) with the profiled grinding tool (6) disposed thereon is introduced into the rolling bearing ring (2) to be worked and subsequently moved radially until the racetrack of the rolling bearing (2) has approximately assumed its final contour. Subsequently the grinding tool (6) is moved in the radial and then in the axial direction into its starting position.

In the meantime, the now ground rolling bearing ring (2) is moved in the axial direction away from the grinding tool so that the contact with the glide shoes (3) and (4) is cancelled and it is now inserted with its external surface area as glide bearing area into a bearing shell (12) surrounding it. In preferred embodiments, the glide bearing used in the homing process comprises a hydrostatic glide bearing (12) . In this position the rolling bearing ring (2) is pressed by means of the pressure rollers (15) axially against a further non-magnetic rotary drive (14) such that it is axially fixed as well as being able to rotate at the speed customary for honing.

For honing, the honing stone (9) disposed on the (SFC) holder (8) is moved axially into the opening of the rolling bearing ring (2) and oriented opposite the inner surface of the rolling bearing ring (2) so as to be worked on by it. Subsequently the honing stone (9) with the honing stone holder (8) is moved radially so far into the direction of the rolling bearing running surface that it comes into contact with it and a defined pressure force is created. The honing stone holder (8), in turn, is fastened on a yoke (7). During the now following honing the yoke (7) with holder (8) and honing stone (9) are brought into an oscillating rotary motion wherein their center and the center of the circular cross-sectional area of the ball bearing ring coincide. The rotary motion of the rolling bearing ring (2) relative to the bearing shell (12) is carried out over the lubrication means film disposed between both parts wherein its good dampening properties effect the honing working very advantageously. The oscillation motion of the honing stone (9) is first carried out with relatively high frequency, however, and toward the end of the honing it becomes slower. During this time the rotational speed of the workpiece is increased from an initially relatively low value to the above-mentioned final speed. After the completed prehoning the honing stone (9) with its holder (8) as well as yoke (7) and rotary unit (10) is first raised radially off the worked surface and is subsequently axially completely moved out of the working area.

Figure 3:
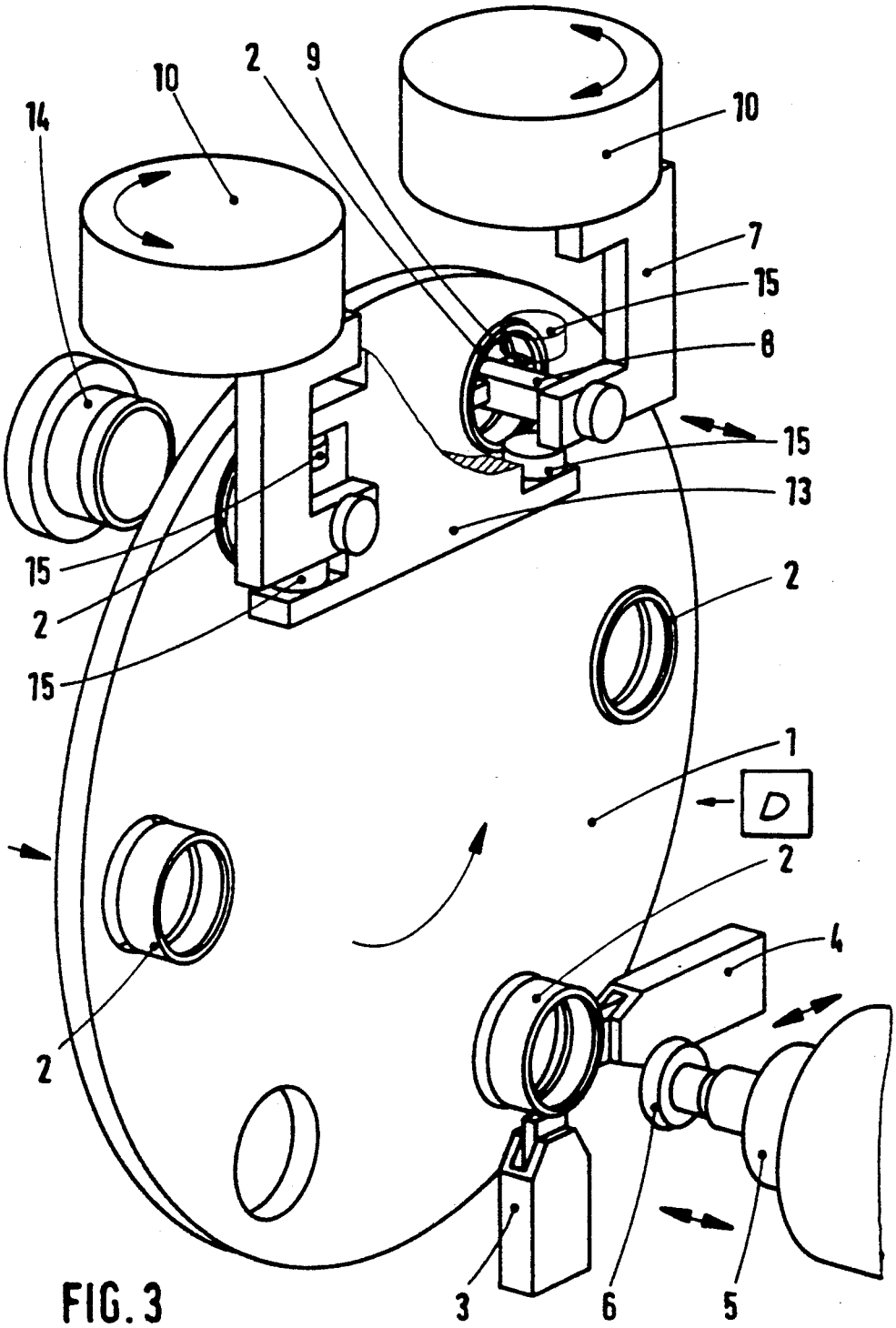
FIG. 3 illustrates this workpiece chucking in multiple arrangement and in cooperation with each other as component part of a complete combined working machine.

FIG. 3 shows the individual functions and operations in connection and in cooperation with the constructional environment. A clock wheel rotatable about its axis of symmetry or a round table (1) indexable and rotatable about its axis of symmetry in this example has a total of 6 workpiece receptacles. The rolling bearing ring (2) is first fed to the working station which in this representation is disposed at the lower right where it rests on the glide shoes (3) and (4) and is worked by the grinding tool (6) mounted on the spindle (5). The glide shoes (3) and (4) are not fastened on the indexable round table (1) but rather on the machine frame not shown here. If the rolling bearing ring (2) is shifted axially in the direction toward the round table (1) after the grinding operation, then therewith the path for the further clocking of the round table (1) is opened. Before the rolling bearing ring (2) reaches the prehoning station it is stopped in an intermediate position by the clock motion of the round table common for all workpieces where demagnetization (D), shown in FIG. 3, takes place in known manner as preparation for the honing process. The stepwise further clocking of the round table (1) then leads the individual rolling bearing ring to the prehoning and further to the finish honing wherein the oscillating motion of the honing stone (9) is introduced via the honing stone holder (8) and the yoke (7) from an oscillation (SIC) unit (10). After a further clock step of the round table (1) the now completely worked rolling bearing ring (2) is pushed axially from the bearing shell (12) surrounding it so that this place is released for the reception of a further unworked rolling bearing ring.

The invention is not intended to be limited to the embodiments shown in the Figures, it being understood that those skilled in the art could make obvious modifications within the scope of the appended claims.

What is claimed is:

1. A chucking apparatus for the combined grinding and honing of a workpiece comprising a racetrack surface of a roller-bearing external ring, comprising:

an indexable turntable, said turntable including a receptacle for receiving a workpiece, said turntable being rotatable about an axis such that the workpiece can be moved to a plurality of work stations.

a first chucking device for precisely grinding said workpiece to desired dimensions, a second chucking device for honing said workpiece such that said workpiece has a substantially uniform contour, said first and second chucking devices disposed at different angular locations around said turntable, said first chucking device comprising means for grinding said workpiece, said grinding means being arranged such that relative movements between said grinding means and said workpiece are path-bound, said first chucking device including a pair of glide-shoes for rigidly supporting said workpiece when said grinding means contacts said workpiece, said second chucking device axially offset with respect to said first chucking device, said second chucking device comprising means for honing said workpiece, said second chucking device being arranged such that relative movements between said honing means and said workpiece are force-bound, a hydrostatic glide bearing having a predetermined flexibility relative to said workpiece and arranged in said receptacle of said turntable; and a workpiece spindle for moving said workpiece axially into and out of contact from said glide shoes of said first chucking device and into said glide bearing, such that when said turntable is rotated about said axis, said second chucking device is brought into contact with the workpiece, such that said workpiece is subjected to grinding and honing in precisely the same axial orientation.

2. The chucking apparatus of claim 1, further comprising a machine frame, said first chucking device connected to said chucking frame.

3. The chucking apparatus of claim 1, wherein said turntable comprises a plurality of workpiece receptacles and wherein a flide bearing is integrated into each of said receptacles as a multiple arrangement in said turntable.

4. The chucking apparatus of claim 3, wherein said honing means is moved axially into the opening of the workpiece disposed in said glide bearing, said chucking apparatus further comprising means for axially fixing the workpiece while allowing the workpiece to rotate in said glide bearing.

5. The chucking apparatus of claim 3, further comprising a third chucking device axially offset with respect to said first chucking device and orientated between said first and said second chucking devices in the rotating direction of said turntable. said third chucking device comprising means for prehoning said workpiece, said honing device being arranged such that relative movements between said prehoning means and said workpiece are force-bound.

6. The chucking device of claim 4, wherein said workpiece spindle provides an electromagnetic force to said workpiece, said chucking device further comprising demagnetization means located prior to said third chucking device in the rotating direction of said turntable, said demagnetization means demagnetizing the workpiece prior to honing.

* * * * *